US008986066B2

(12) United States Patent
Ferreyra et al.

(10) Patent No.: US 8,986,066 B2
(45) Date of Patent: Mar. 24, 2015

(54) ROTATING TOP ASSEMBLY TOY PLAY SET AND METHOD FOR LAUNCHING A ROTATING TOP

(71) Applicants: Gustavo Ricardo Ferreyra, Los Angeles, CA (US); Anthony M. Martino, Thousand Oaks, CA (US)

(72) Inventors: Gustavo Ricardo Ferreyra, Los Angeles, CA (US); Anthony M. Martino, Thousand Oaks, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/907,307

(22) Filed: May 31, 2013

(65) Prior Publication Data

US 2013/0324005 A1 Dec. 5, 2013

Related U.S. Application Data

(60) Provisional application No. 61/654,428, filed on Jun. 1, 2012.

(51) Int. Cl.

| | |
|---|---|
| ***A63H 1/06*** | (2006.01) |
| ***A63H 18/02*** | (2006.01) |
| ***A63H 18/10*** | (2006.01) |
| *A63H 1/02* | (2006.01) |
| *A63H 18/16* | (2006.01) |

(52) U.S. Cl.

CPC ..... *A63H 1/02* (2013.01); *A63H 18/026* (2013.01); *A63H 18/10* (2013.01); *A63H 2018/165* (2013.01)

USPC ..... 446/259

(58) Field of Classification Search

CPC ..... A63H 1/02; A63H 1/06; A63H 29/24; A63H 17/004

USPC ..... 446/259

See application file for complete search history.

(56) References Cited

U.S. PATENT DOCUMENTS

| | | | |
|---|---|---|---|
| 15,475 | A | 8/1856 | Coates |
| 33,284 | A | 9/1861 | Wright |
| 45,816 | A | 1/1865 | Cramer |
| 202,118 | A | 4/1878 | Raetz |
| 202,742 | A | 4/1878 | Mohr |
| 299,703 | A | 6/1884 | Volke |
| 387,761 | A | 8/1888 | Briggs |

(Continued)

FOREIGN PATENT DOCUMENTS

| | | |
|---|---|---|
| CN | 201120172 Y | 9/2008 |
| FR | 2591905 | 6/1987 |

(Continued)

OTHER PUBLICATIONS

English Translation for CN201120172Y.

(Continued)

*Primary Examiner* — Kurt Fernstrom
*Assistant Examiner* — Dolores Collins
(74) *Attorney, Agent, or Firm* — Cantor Colburn LLP

(57) ABSTRACT

A rotating top assembly toy play set includes at least one track segment having a starter section, a launch section and a guiding path therebetween. Also included is a rotatable top configured to translate along the guiding path. Further included is a top receiving structure positionally spaced from the launch section for receiving the rotatable top subsequent to a flight of the rotatable top, wherein the flight extends along an aerial trajectory between the launch section and the top receiving structure.

20 Claims, 12 Drawing Sheets

(56) References Cited

U.S. PATENT DOCUMENTS

| | | | | | |
|---|---|---|---|---|---|
| 458,483 | A | | 8/1891 | Phipps | |
| 561,492 | A | | 6/1896 | Cluxton | |
| 566,922 | A | | 9/1896 | Maynard | |
| 567,008 | A | | 9/1896 | Segassie | |
| 602,019 | A | | 4/1898 | Steppan | |
| 615,930 | A | | 12/1898 | Warren | |
| 643,026 | A | | 2/1900 | Young | |
| 706,676 | A | | 8/1902 | Mann | |
| 739,506 | A | | 9/1903 | Purdum | |
| 809,270 | A | | 1/1906 | Phipps | |
| 823,809 | A | | 6/1906 | Powers | |
| 832,960 | A | | 10/1906 | Eibra | |
| 846,047 | A | | 3/1907 | Newman | |
| 847,933 | A | | 3/1907 | Gibbs | |
| 945,484 | A | | 1/1910 | Anderson | |
| 960,715 | A | | 6/1910 | Schneider | |
| 1,005,020 | A | | 10/1911 | Gibbs | |
| 1,060,612 | A | | 5/1913 | Mangelsdorff | |
| 1,099,615 | A | | 6/1914 | Purse | |
| 1,115,863 | A | | 11/1914 | Preyer | |
| 1,130,461 | A | | 3/1915 | Zolper | |
| 1,133,756 | A | | 3/1915 | Smith | |
| 1,208,975 | A | | 12/1916 | John | |
| 1,317,699 | A | | 10/1919 | Gibbs | |
| 1,364,632 | A | | 1/1921 | Harrington | |
| 1,368,040 | A | | 2/1921 | Lindstrom | |
| 1,411,974 | A | * | 4/1922 | Mann | 446/138 |
| 1,590,242 | A | | 6/1924 | Howard | |
| 1,499,803 | A | | 7/1924 | Cayo | |
| 1,570,206 | A | | 1/1926 | Connell | |
| 1,680,423 | A | | 8/1928 | Lindstrom | |
| 1,695,486 | A | | 12/1928 | Gibbs | |
| 1,959,635 | A | | 5/1934 | Moore | |
| 2,188,824 | A | | 1/1940 | Thigpen | |
| 2,375,986 | A | | 5/1945 | Gandy | |
| 2,534,538 | A | | 12/1945 | Thoresen | |
| 2,627,412 | A | | 6/1951 | Bronson | |
| 2,610,099 | A | * | 9/1952 | McNamara, Jr. | 108/140 |
| 2,919,920 | A | | 6/1957 | Heape | |
| 2,827,337 | A | * | 3/1958 | Buffum | 305/124 |
| 2,892,287 | A | | 6/1959 | Weinstein | |
| 2,971,288 | A | | 7/1959 | Gill | |
| 3,308,575 | A | | 3/1967 | Lemelson | |
| 3,318,600 | A | | 5/1967 | Glass et al. | |
| 3,410,022 | A | | 11/1968 | Behl | |
| 3,429,573 | A | * | 2/1969 | Cederberg | 273/108 |
| 3,451,161 | A | | 6/1969 | Lemelson | |
| 3,466,796 | A | | 9/1969 | Greenblatt | |
| 3,498,612 | A | | 3/1970 | Ellis | |
| 3,542,366 | A | | 11/1970 | Schoker | |
| 3,591,181 | A | | 7/1971 | Stewart | |
| 3,628,285 | A | | 12/1971 | Murakami | |
| 3,641,704 | A | | 2/1972 | Sims et al. | |
| 3,674,271 | A | | 7/1972 | De Gelder et al. | |
| 3,775,897 | A | | 12/1973 | Soulakis et al. | |
| 3,789,542 | A | | 2/1974 | Sims et al. | |
| 3,815,911 | A | | 6/1974 | Cooper | |
| 3,898,762 | A | * | 8/1975 | Balleis | 446/259 |
| 4,016,854 | A | | 4/1977 | Lehman | |
| 4,200,283 | A | * | 4/1980 | Andrews et al. | 273/108 |
| 4,248,426 | A | | 2/1981 | Sims et al. | |
| 4,251,949 | A | | 2/1981 | Buck et al. | |
| 4,286,406 | A | | 9/1981 | Sims et al. | |
| 4,408,413 | A | | 10/1983 | Hyland et al. | |
| 4,513,967 | A | | 4/1985 | Halford et al. | |
| 4,516,953 | A | | 5/1985 | Hippely et al. | |
| 4,531,923 | A | | 7/1985 | Lohr | |
| 4,558,867 | A | | 12/1985 | Hippely | |
| 4,575,346 | A | | 3/1986 | Ogawa | |
| RE32,106 | E | | 4/1986 | Lemelson | |
| 4,605,230 | A | | 8/1986 | Halford et al. | |
| 4,753,623 | A | | 6/1988 | Krut | |
| 4,795,396 | A | | 1/1989 | Lindstrom | |
| 4,867,728 | A | * | 9/1989 | Moomaw | 446/259 |
| 4,932,918 | A | | 6/1990 | Onoda | |
| 4,948,136 | A | * | 8/1990 | Hildebrandt | 273/109 |
| 4,961,577 | A | | 10/1990 | Gebert | |
| 4,964,637 | A | | 10/1990 | Gebert | |
| 5,007,877 | A | | 4/1991 | Watson | |
| 5,024,625 | A | | 6/1991 | MacCarthy | |
| 5,026,057 | A | | 6/1991 | Watford | |
| 5,129,655 | A | | 7/1992 | Gillespie et al. | |
| 5,324,226 | A | * | 6/1994 | McKay et al. | 446/264 |
| 5,498,192 | A | * | 3/1996 | McKay et al. | 446/264 |
| 5,506,459 | A | | 4/1996 | Ritts | |
| 5,518,437 | A | | 5/1996 | Nonaka et al. | |
| 5,545,068 | A | | 8/1996 | Asbaghi | |
| D380,022 | S | | 6/1997 | Kusumi et al. | |
| D387,099 | S | | 12/1997 | Kusumi et al. | |
| 5,971,830 | A | * | 10/1999 | Tobin | 446/256 |
| 6,089,946 | A | | 7/2000 | Yang | |
| 6,093,079 | A | * | 7/2000 | House | 446/444 |
| 6,312,306 | B1 | | 11/2001 | Kroll | |
| 6,435,929 | B1 | | 8/2002 | Halford | |
| 6,485,017 | B1 | | 11/2002 | Ng | |
| 6,604,978 | B1 | | 8/2003 | Abel | |
| 6,685,531 | B1 | | 2/2004 | Tiefel et al. | |
| 6,739,939 | B2 | | 5/2004 | Matsukawa | |
| 6,746,300 | B1 | | 6/2004 | Matsukawa | |
| 6,769,953 | B1 | | 8/2004 | Sutton et al. | |
| 6,773,328 | B2 | | 8/2004 | Tiefel et al. | |
| 6,791,221 | B1 | * | 9/2004 | Lan | 310/89 |
| 6,793,151 | B2 | | 9/2004 | Kimbrough | |
| 6,905,389 | B2 | | 6/2005 | Matsukawa | |
| 6,913,506 | B2 | | 7/2005 | Tiefel et al. | |
| 6,913,508 | B2 | * | 7/2005 | Hornsby et al. | 446/438 |
| 7,018,263 | B2 | | 3/2006 | Tiefel et al. | |
| 7,275,974 | B2 | | 10/2007 | Perry | |
| 7,435,152 | B2 | | 10/2008 | Kimbrough | |
| 7,575,498 | B2 | | 8/2009 | Perry | |
| 7,766,720 | B2 | * | 8/2010 | Ostendorff | 446/444 |
| 8,083,566 | B2 | | 12/2011 | Finlan | |
| 8,210,895 | B2 | | 7/2012 | Bertrand et al. | |
| 8,568,191 | B2 | * | 10/2013 | Rehkemper et al. | 446/259 |
| 2005/0070203 | A1 | | 3/2005 | Beckett | |
| 2006/0258259 | A1 | | 11/2006 | Lin | |
| 2009/0197503 | A1 | | 8/2009 | Grosu | |
| 2011/0086574 | A1 | | 4/2011 | Nuttall et al. | |
| 2012/0088433 | A1 | | 4/2012 | Choe | |
| 2013/0056929 | A1 | * | 3/2013 | Rehkemper et al. | 273/129 R |
| 2014/0094087 | A1 | * | 4/2014 | Colquhoun | 446/259 |

FOREIGN PATENT DOCUMENTS

| | | | |
|---|---|---|---|
| FR | 2614800 | A1 | 11/1988 |
| JP | 2008067919 | A | 3/2008 |
| RU | 66215 | U1 | 9/2007 |
| WO | 2010073080 | A2 | 7/2010 |

OTHER PUBLICATIONS

English Translation for JP2008067919A.
Written Opinion for Application No. PCT/US2013/043687; Date of Mailing: Sep. 12, 2013.
International Search Report for Application No. PCT/US2013/043687; Date of Mailing: Sep. 12, 2013.

* cited by examiner

ROTATING TOP ASSEMBLY TOY PLAY SET AND METHOD FOR LAUNCHING A ROTATING TOP

CROSS REFERENCE TO RELATED APPLICATIONS

This application claims the benefit of U.S. Provisional Patent Application Ser. No. 61/654,428, filed Jun. 1, 2012, the contents of which are incorporated herein by reference thereto.

BACKGROUND

Various embodiments of the present invention are related to toy play sets, and more particularly to rotating top assemblies, as well as a method for launching rotating tops.

Toy play sets having tracks for guiding objects have achieved propulsion and guidance of the objects in various manners. Objects, such as race cars or trains, for example, have translated along a predetermined path by an included motor for generating the propelling force.

Accordingly, it is desirable to provide a rotating top assembly toy play set with features that provide interchangeable accessories to integrate with such rotating top assembly toy play sets.

SUMMARY OF THE INVENTION

In one embodiment, a rotating top assembly toy play set includes at least one track segment having a starter section, a launch section and a guiding path therebetween. Also included is a rotatable top configured to translate along the guiding path. Further included is a top receiving structure positionally spaced from the launch section for receiving the rotatable top subsequent to a flight of the rotatable top, wherein the flight extends along an aerial trajectory between the launch section and the top receiving structure.

In another embodiment, a rotating top assembly toy play set includes at least one track segment having a launch section and a magnetized guiding path therebetween. Also included is a magnetized rotatable top configured to translate along the magnetized guiding path. Further included is a top receiving structure disposed in spaced proximity to the launch section of the at least one track segment, wherein the top receiving structure is configured to receive the magnetized rotatable top.

In yet another embodiment, a method of launching a rotatable top is provided. The method includes initiating a rotational force on the rotatable top for imparting a rotating motion on the rotatable top. Also included is translating the rotatable top along a guiding path of at least one track segment toward a launch section of the at least one track segment. Further included is launching the rotatable top along an aerial trajectory extending from the launch section to a top receiving structure.

DETAILED DESCRIPTION

Figure 1:
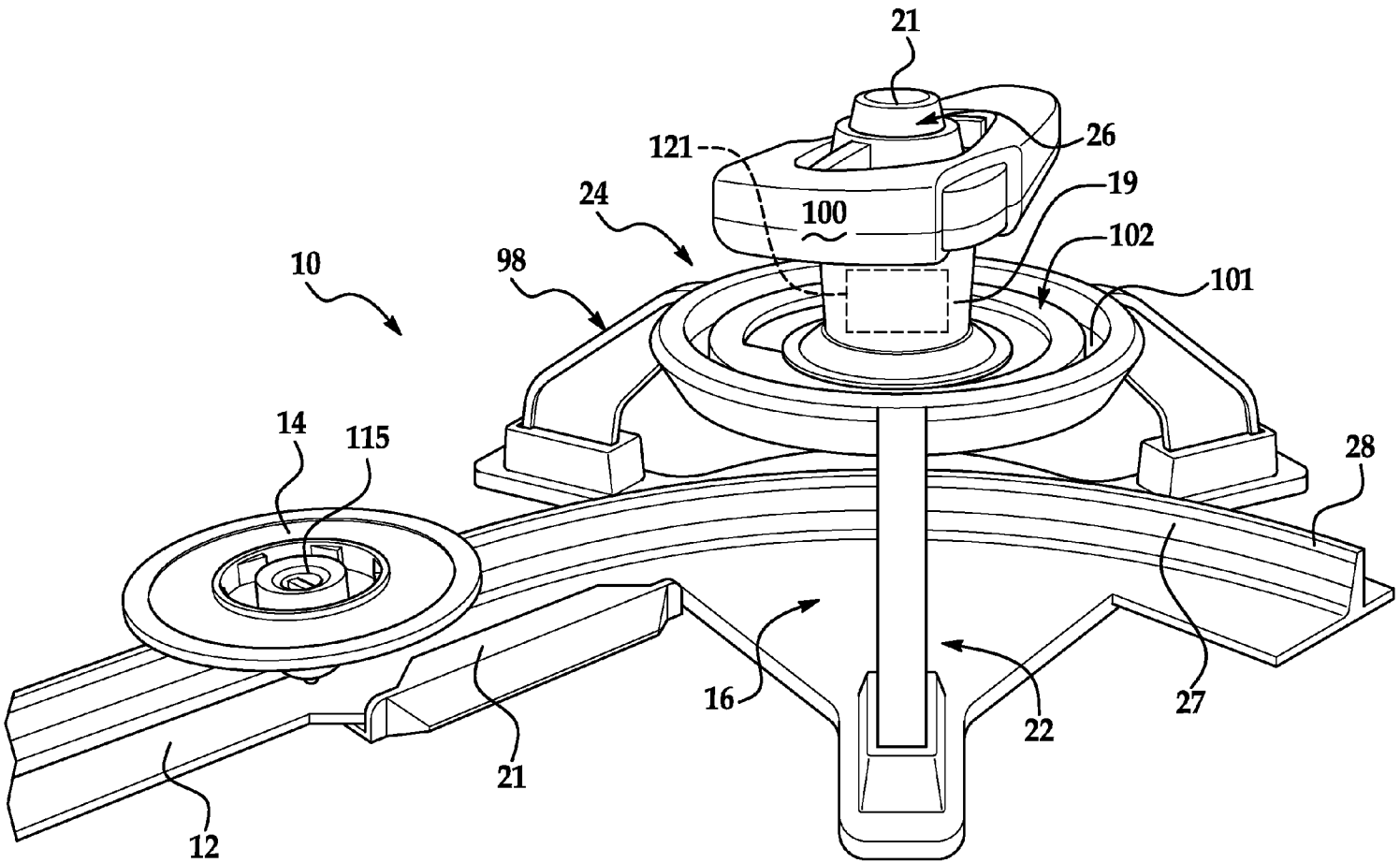
FIG. 1 is a perspective view of a portion of a toy play set.
Figure 2:
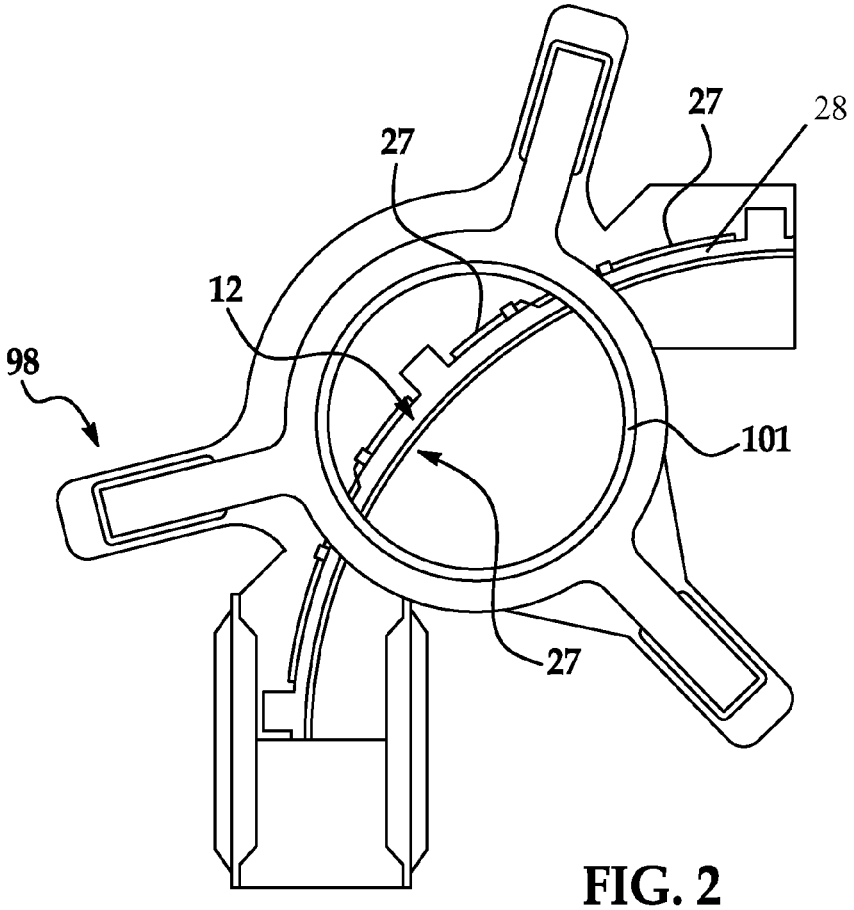
FIG. 2 is a top, plan view of a starter section of the toy play set.
Figure 3:
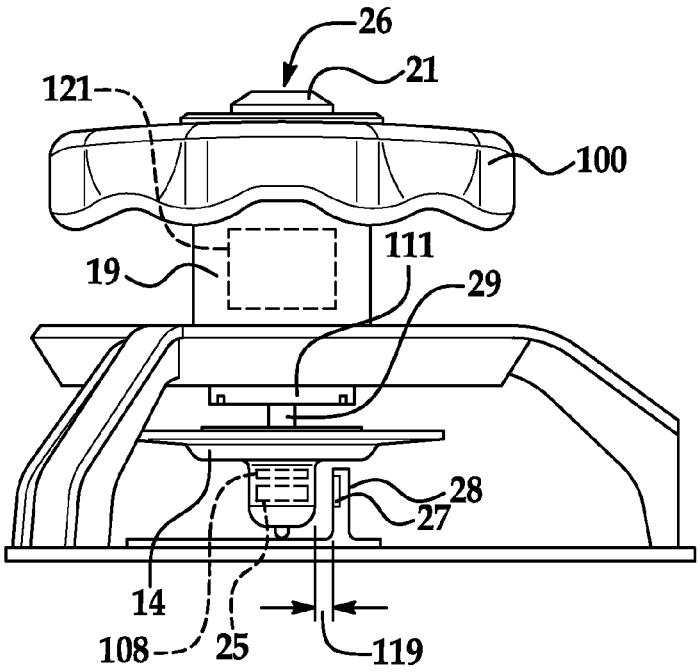
FIG. 3 is a side, elevational view of a starter section of the toy play set launching a top therefrom.
Figure 4:
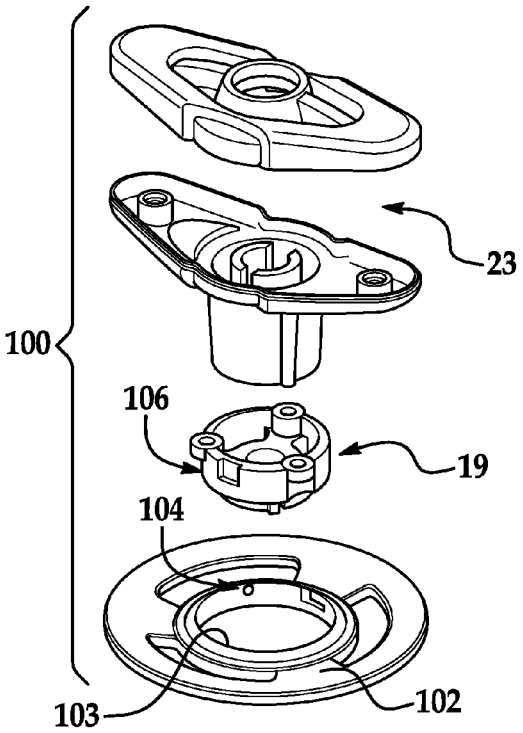
FIG. 4 is an exploded, perspective view of an initiator for applying a rotational force to the top and configured for use with the starter section of the toy play set.
Figure 5:
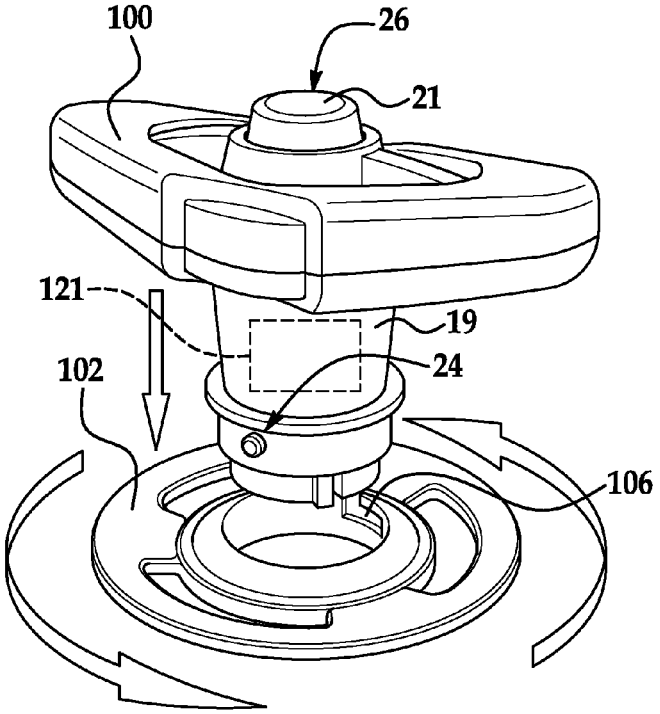
FIG. 5 is a perspective view of the initiator.

Referring now to FIGS. 1-6, a rotating top assembly toy play set is illustrated and generally referred to with numeral 10. The rotating top assembly toy play set 10 includes at least one track segment or a plurality of track segments 12 configured to guide a rotatable top 14 along a guiding path 16 through a magnetic coupling between a magnet of the top and a ferromagnetic material or metal disposed along the track, so that the rotating top follows the path 16.

In one embodiment, the track segments 12 are interchangeable to provide a variety of guiding paths 16 for the top 14 to travel along. In one non-limiting exemplary embodiment, the at least one track segment 12 or toy play set 10 includes a starter section 22 for launching (e.g., applying a rotational force to the top 14 such that the top 14 will traverse along the guiding path 16 of the toy play set 10). In one embodiment, the starter section 22 includes a retaining portion 24 configured to removably receive an initiator or top launcher 26 and position it above the track segment 12 in a predetermined location with respect to the track segment 12 and the metal or ferromagnetic material of the track 12 so that the top 14 can be released onto the track segment 12 and rotate along the path 16.

The initiator or top launcher 26 is configured to retain and release the rotatable top 14 while also imparting a rotational force thereto so that the top 14 can travel along track segments 12 of the toy play set 10. As illustrated, the retaining portion 24 is elevated from the path 16 and operably supported by one or more structures 98, such as a tripod, however, it is to be appreciated that any number of supporting structures may be employed. The structure 98 is configured to support the initiator or launcher 26 in a predetermined location above a portion of a track segment 12 having a metal or ferromagnetic material so that a magnet of the top is attracted thereto after it is released and launched from initiator or launcher 26. The retaining portion 24 retains and supports the initiator 26, which also includes a handle assembly 23.

To initiate rotational launching of the rotatable top 14, the initiator 26, has a switch or depressable button 21, which when depressed causes a rotational force to be applied to the rotatable top 14. In an exemplary embodiment, the rotatable force is sufficient to generate stable rotation of the rotatable top 14 as it travels along path 16.

In one non-limiting embodiment, the handle assembly 23 includes a handle 100 that is operably connected to a retaining portion 19 of the initiator 26 by at least one, but typically a plurality of mechanical fasteners. In one embodiment, the retaining portion 19 also includes a removable retaining ring 102 that fittingly or snap fittingly engages the retaining portion 19. The engagement may be facilitated by one or more detents 104 on the removable retaining ring 102 configured to engage one or more corresponding recesses 106 disposed within the retaining portion 19. Alternatively, the detents 104 are located on the retaining portion 19 and the recesses 106 are located on the retaining ring 102. In this embodiment or in the previous embodiment, the removable retaining ring 102 may be assembled to the retaining portion 19 and the handle assembly 100 by engagement of the one or more detents 104 with the one or more corresponding recesses 106, followed by a twisting of the removable retaining ring 102 into a locked position. Additionally, the removable retaining ring 102 may be configured to reside within a flange portion 101 of the starter section 22 or the one or more structures 98, such as the above-noted tripod. In other words, the outer periphery of the retaining ring 102 is slightly larger than the opening defined by flange 101 so retaining ring 102 can be placed or rested on flange 101. Once placed within the opening and upon flange 101, the initiator or launcher 26 and the top 14 releasably secured thereto is ready to be launched onto the track segment 12 disposed below the starter section 22.

In addition to the aforementioned detents 104 and recesses 106, the coupling and decoupling of the removable retaining ring 102 may be facilitated by use of at least one aperture 103 disposed in the removable retaining ring 102. It is envisioned that the at least one aperture 103 may be particularly helpful for children during coupling and decoupling of the removable retaining ring 102.

In addition to helping sit the initiator or launcher 26 onto flange 101, the retaining ring 102 in one non-limiting embodiment also has an integral collar or guide member 111 that extends away from retaining ring 102 and its distal end or surface may contact an upper surface of the top 14 in order to assist in proper launching (e.g. leveling of the top 14 as it is launched) as will be discussed below. In other words, the top 14 will be launched such that its vertical rotational axis is substantially aligned with the metal or ferromagnetic material of the track located on a sidewall 28 of the track 12, so that the magnet of the top is properly drawn thereto in order to facilitate rotational movement of the top 14 along the path 16.

Extending downward from the initiator 26 is a plunger 29 that is movably secured thereto and moves when button 21 is depressed. Movement of the plunger 29 corresponds to the application of a rotational force from the initiator 26 to the top 14 as it is being launched therefrom. When the button 21 is depressed, the plunger 29 protrudes into a recess 115 disposed within an upper portion of the rotatable top 14 during depression of the initiator or launcher 26. By slightly protruding into the recess, the rotatable top 14 is stabilized during the initiation of rotation of the rotatable top 14. Initiation of rotation to the top 14 by initiator 26 is facilitated by anyone of plurality of winding mechanisms, spinning mechanisms, rotating mechanisms 121 or equivalents thereof known to those skilled in the related arts for example, a one way clutch winder, which winds a spring mechanism that stores potential energy and that potential energy is release to the top 14 in order to apply a rotational force to the top 14 so that it is able to travel rotationally along path 16. For example and in one non-limiting embodiment, the top 14 is secured to the initiator or launcher 26 and is wound or rotationally move with respect to the initiator 26 in a first direction thereby storing potential energy and a spring mechanism, winding mechanism, spinning mechanism, rotating mechanism or equivalent thereof that is released when button 21 is depressed and the stored potential energy is applied as kinetic energy to the top 14 in a second direction, which is substantially opposite to the first direction such that the top 14 is rotationally launched from the initiator 26.

Non-limiting examples of such mechanisms or equivalents thereof 121 are found in the following U.S. Pat. Nos. 33,284; 45,816; 202,118; 202,742; 566,922; 823,809; 1,005,020; 1,115,863; 1,208,975; 1,317,699; 1,570,206; 1,680,423; 1,695,486; 2,547,369; 3,224,142; 3,254,446; 6,089,949; and 6,769,953 the contents each of which are incorporated herein by reference thereto. Upon depression of the button 21 of the initiator 26, the rotatable top 14 is detached or moved away from the initiator 26 as it is also rotated by a mechanism 121 of the initiator/launcher 26, which is operatively coupled to the top 14 and button 21. In an alternative embodiment, the mechanism 121 comprises an electrically powered motor that is activated upon actuation of button 21 such that a rotational force is applied to the top 14 and the top is released from initiator 26.

In accordance with an exemplary embodiment, the initiator 26 and the plunger 29 are positioned at a predetermined distance from an inner surface of the track sidewall 28. In one embodiment, the track sidewall 28 is vertically orientated with respect to a base portion of the track segment 12. The predetermined distance must be small enough to provide a sufficient magnetic attraction between the rotatable top 14 via at least one magnet 25 disposed within or on the rotatable top 14 and a metal, ferromagnetic material, etc. 27 either within or on the at least one track segment 12 that will draw the magnet of the top thereto and facilitate rotational movement of the top 14 along the path 16.

In one exemplary embodiment, the material 27 is insert molded or secured to the track sidewall 28 such that it is flush with other surfaces of the sidewall 28 in order to facilitate rotational movement of the top 14 along sidewall 28 of track segment 12. Additionally, the predetermined distance must be great or large enough to avoid a magnetic force capable of tilting the rotational axis of the rotatable top 14 into a failure mode during release from the initiator/launcher 26 (e.g., causing the top 14 to rotate at an angle that would be prohibitive to rotational movement of the top 14 along path 16) as well as being close enough to draw the top 14 via the magnet 25 towards the ferromagnetic material or metal 27. A non-limiting example of this predetermined distance 119 is illustrated in at least FIG. 3. For example, if the top 14 were to rotate at an undesired angle the magnetic coupling of magnet 25 with respect to a ferromagnetic material 27 would be undesirable to facilitate the desired or optimal movement of top 14 along the track segment 12 of the toy, play set 10.

The at least one magnet 25 of the top 14 may comprise or be supplemented by a washer 108 disposed at an interior location of the rotatable top 14. In one embodiment, the washer 108 may be disposed above and/or below the at least one magnet 25 and within the rotatable top 14 in order to enhance or provide a stronger magnetic attraction to the metal, ferromagnetic material, magnetic member or magnetic material 27 of the at least one track segment 12. Furthermore and in an alternative configuration, it is contemplated that the washer 108 may also, or alternatively, be disposed within the retaining portion 19 in order to enhance magnetic attraction between the top 14 and the initiator 26.

Figure 6A:
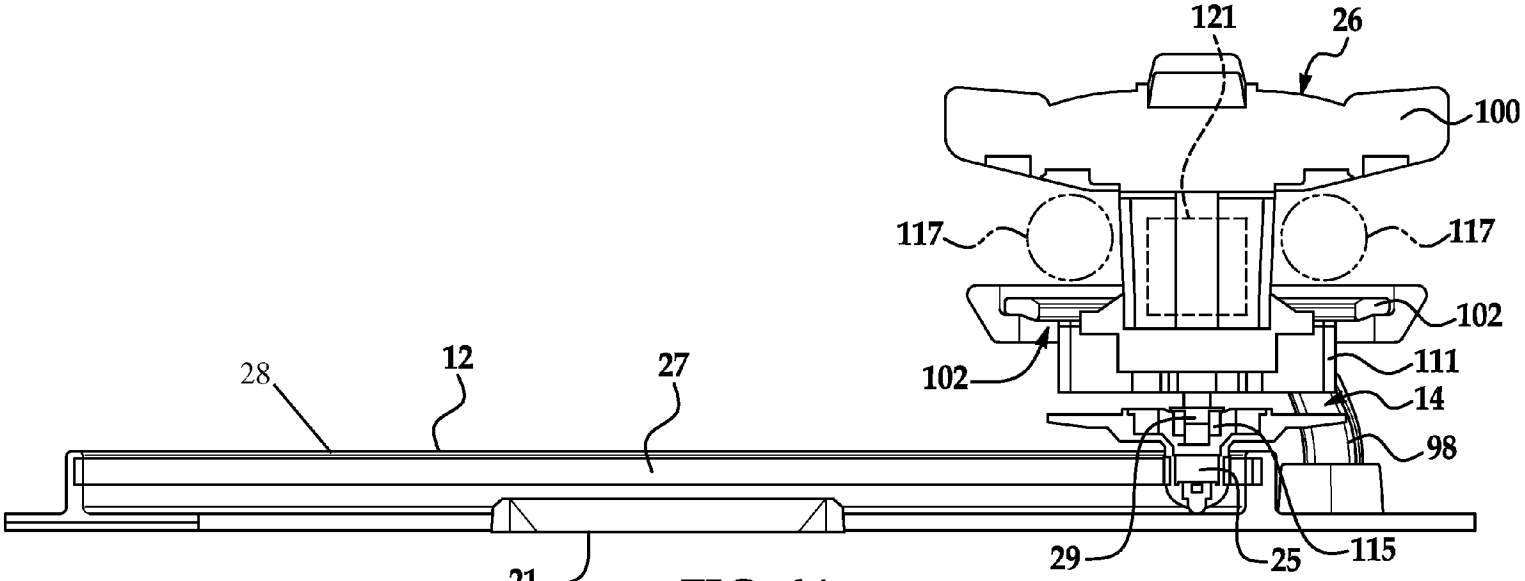
FIGS. 6A and 6B are cross-sectional views of the starter section of the toy play set illustrating a top being launched therefrom.
Figure 6B:
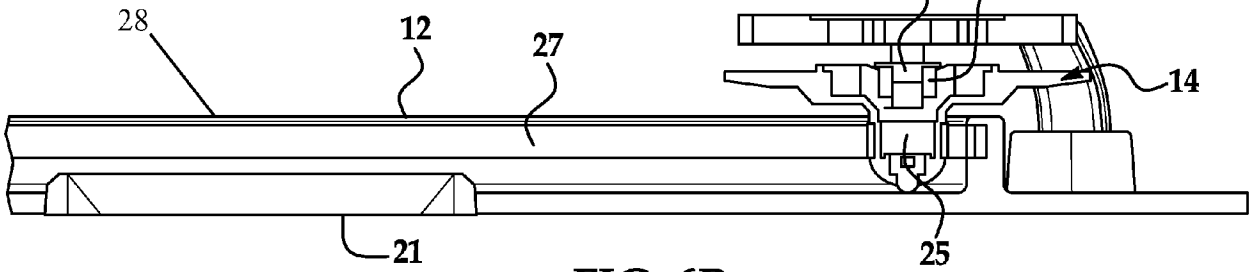

In accordance with one exemplary embodiment, and as illustrated in at least FIG. 6A, the handle 100 is spaced from retaining ring 102 in order to provide an area for receipt of a user's fingers when they are grasping handle 100. This area is illustrated schematically as area 117 in FIG. 6A.

Figure 7:
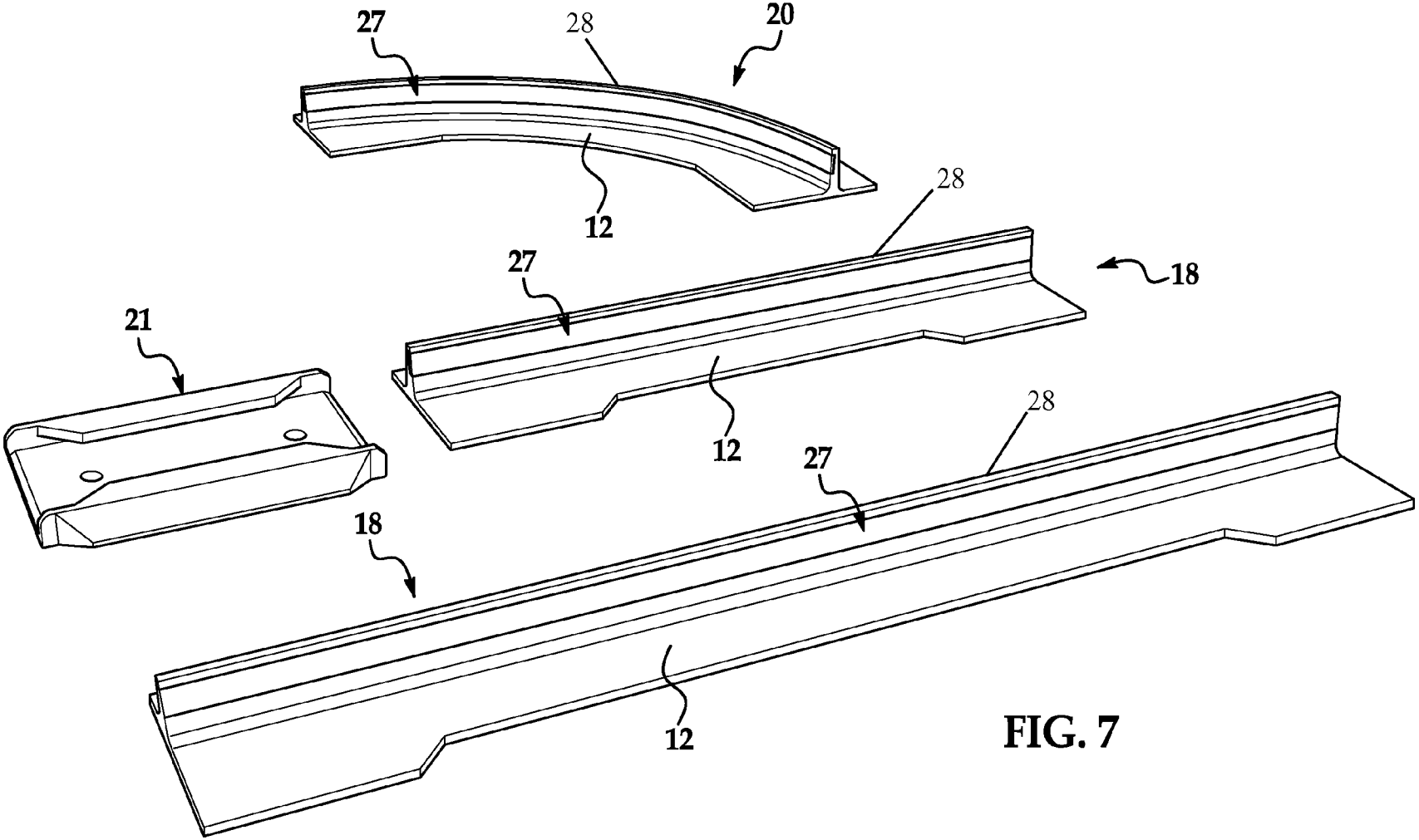
FIG. 7 is a perspective view of a plurality of track segments configured for use with the toy play set.
Figure 8A:
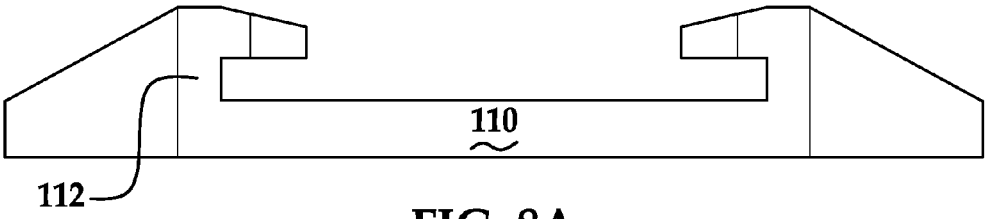
FIGS. 8A and 8B are cross-sectional views of track segments configured for use with the toy play set.
Figure 8B:
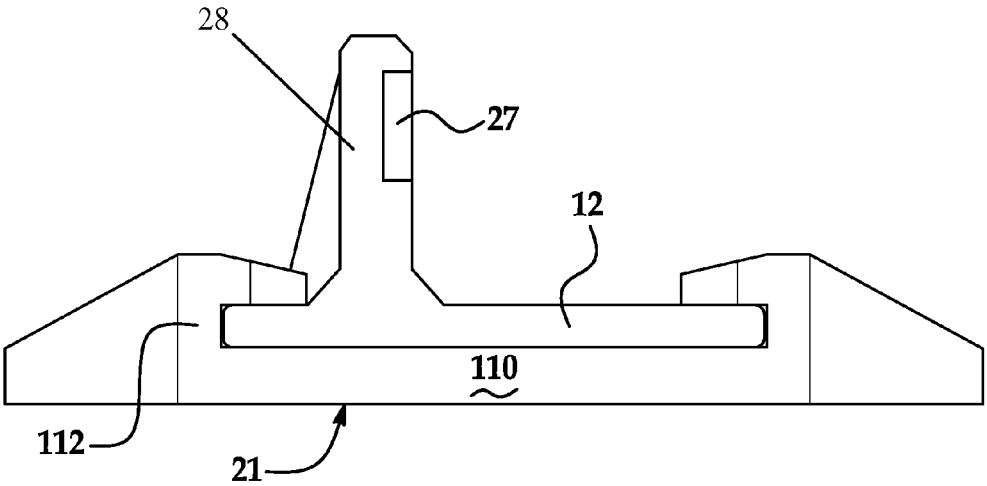

Referring now to FIGS. 7 and 8 and upon generation of stable rotation, the rotatable top 14 begins translational movement along the at least one track segment 12 (see at least FIG. 10) through rotational movement and magnetic coupling between the top 14 and sidewall 28 of the track segment 12. The track segment or segments 12 may include any number of geometries that define the guiding path 16. For example, the guiding path 16 may include one or more straightaways 18 and/or curved portions 20, with the at least one track segment 12 comprising a variety of dimensions, such as length, height and radius of curvature. Additionally, the at least one track segment 12 may comprise a plurality of track sections that may be fitted together with one or more track connectors 21 to form a variety of unique guiding paths 16. Each of the one or more track connectors 21 includes a base portion 110 and an upwardly extending hook portion 112 configured to engage and retain the at least one track segment 12.

Irrespective of the precise guiding path 16 formed by the at least one track segment 12, the rotatable top 14 is translated thereon. The translational movement results from conversion of the rotational movement of the rotatable top 14 to the translational movement along the guiding path 16. Additionally, the rotatable top 14 is magnetized by inclusion of a magnetic portion 25, either within or on, the rotatable top 14. Such a magnetized portion 25 may comprise a magnetized rod or segment disposed centrally within the rotatable top 14. Alternatively, a surface of the rotatable top 14 may comprise or be coated with a magnetic material. Irrespective of the portion of the rotatable top 14 that is magnetized, the rotatable top 14 is configured to magnetically interact with an appropriate member (e.g., metal, ferromagnetic material, equivalents thereof) 27 of the at least one track segment 12 to accelerate and guide the rotatable top 14 along the guiding path 16 in a translational manner. As noted above, magnetic interaction between the rotatable top 14 and the at least one track segment 12 is achieved by disposition of the material 27, either within or on, the at least one track segment 12. The at least one material, metal, ferromagnetic material, etc. 27 may be integrally formed or operably coupled to the at least one track segment 12, and more specifically to a track sidewall 28 and/or a guide path surface 30. Enhanced magnetic attraction between the rotatable top 14 and the at least one track segment 12 is achieved by disposition of the at least one material or metal 27 on both sides of the track sidewall 28 (see for example at least FIG. 2). This may particularly useful in certain track configurations such as curves or launching area wherein additional or a stronger magnetic attraction is desired to counter act other forces acting upon the rotatable top 14.

An exemplary embodiment of the at least one material, metal, ferromagnetic material, member or magnetic member 27 comprises a ferromagnetic material. The term "ferromagnetic material" for purposes of this description typically refers to materials that are strongly magnetically attracted to magnets, such as the magnetic portion or magnet 25 disposed within or on the rotatable top 14, and have the capacity to strengthen the magnetic field in different parts of a magnetic circuit. The ferromagnetic material disposed within or on the at least one track segment 12 propels and attracts the rotatable top 14 by interaction with the polarization of the magnetic portion within or on the rotatable top 14. It is, of course, understood that in an alternative embodiment, magnets may be disposed along the track and the ferromagnetic materials may be located in the top 14 in order to provide the magnetic coupling therebetween.

Figure 9:
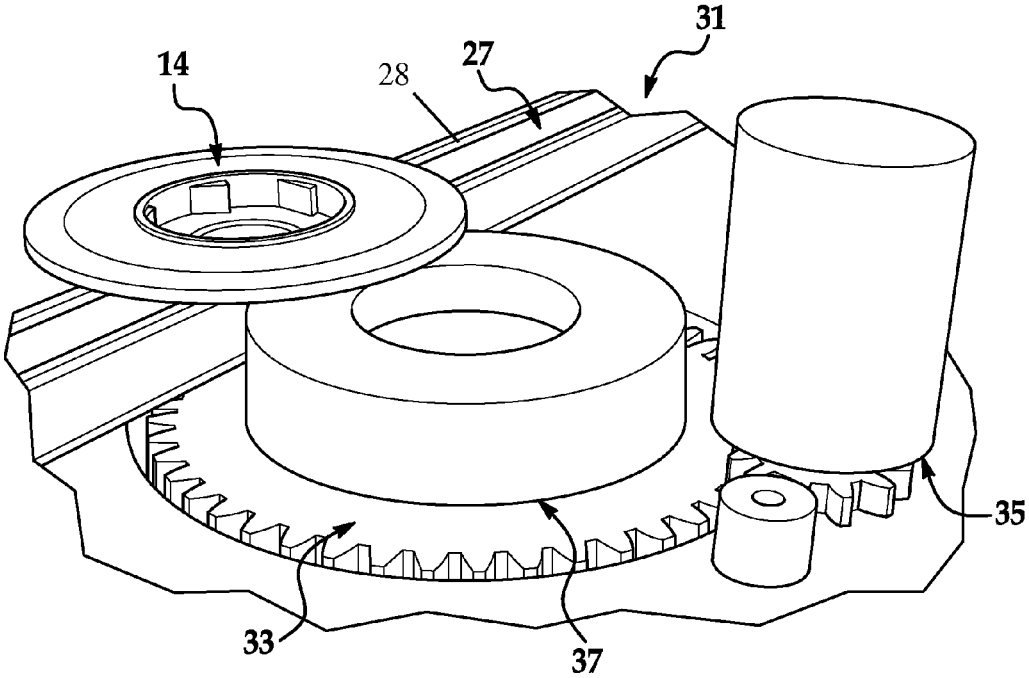
FIG. 9 is a perspective view of a power launching assembly for use in one non-limiting alternative exemplary embodiment of the toy play set.

Referring to FIG. 9, enhanced propulsion may be achieved by disposal of one or more power launching assemblies 31 positioned at one or more locations along the guiding path 16. The power launching assemblies 31 include a gear system 33 powered by an electric motor 35. The gear system 33 transmits power to a wheel 37 made of a material suitable for interaction with a moving rotatable top 14, while not disturbing the rotatable top 14 in a manner that would detrimentally alter the stabilization of the rotatable top 14. Such a material may include foam, for example, however, alternative materials may be employed. While passing by the power launching assembly 31, the rotatable top 14 slightly engages the wheel 37, which is rotating due to the gear system 33. The slight engagement between the rotatable top 14 and the wheel 37 boosts the speed of the rotatable top 14 to achieve greater launching capability, which will be described in detail below.

In one embodiment, the at least one track segment 12 terminates proximate to a launch section 32 that is angled upwardly to provide an aerial trajectory of the rotatable top 14 upon reaching the launch section 32. It is contemplated that the angle of the launch section 32 may be manipulated by a user to control the trajectory of the rotatable top 14 during a flight of the rotatable top 14.

Figure 10:
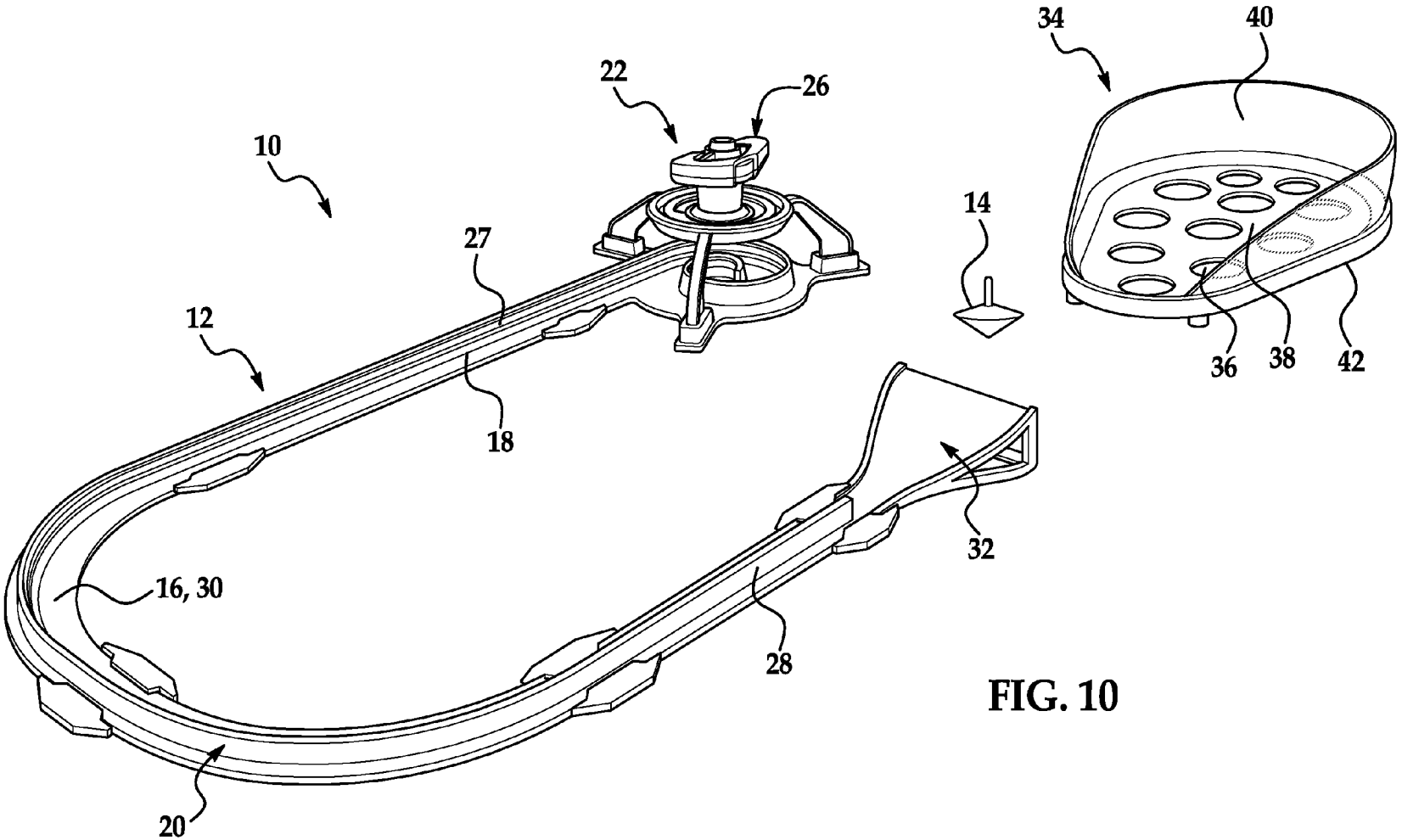
FIG. 10 is a perspective view of a non-limiting embodiment of the toy play set.

In a first embodiment, as illustrated in FIG. 10, the rotatable top 14 is launched toward a top receiving structure 34 that is positioned in a spaced location with respect to the at least one track segment 12, and more specifically the launch section 32. In the embodiment illustrated, the top receiving structure 34 includes at least one, but typically a plurality of apertures 36 disposed within a main surface 38 of the top receiving structure 34. Additionally, to retain the rotatable top 14 in proximity to the main surface 38 of the top receiving structure 34, a peripheral barrier 40 extends upwardly about at least a portion of a perimeter 42 of the main surface 38. The peripheral barrier 40 improves the likelihood that the rotatable top 14 passes through one of the plurality of apertures 36. One aspect of the embodiment contemplates a predetermined point value being assigned to each of the plurality of apertures 36, such that a user is awarded the predetermined point value upon passage of the rotatable top 14 through one of the plurality of apertures 36. For example and when the top 14 is launched by launch section 32 it will land and rotate on surface 38 until it drops into one of the apertures 36. The apertures 36 can be configured to allow the top 14 to pass therethrough or only a portion of the top 14 passes therethrough and an outer peripheral portion of the top will rest on the surface 38 proximate to the aperture 36 while a substantial portion of the top 14 passes into aperture 36.

Figure 11:
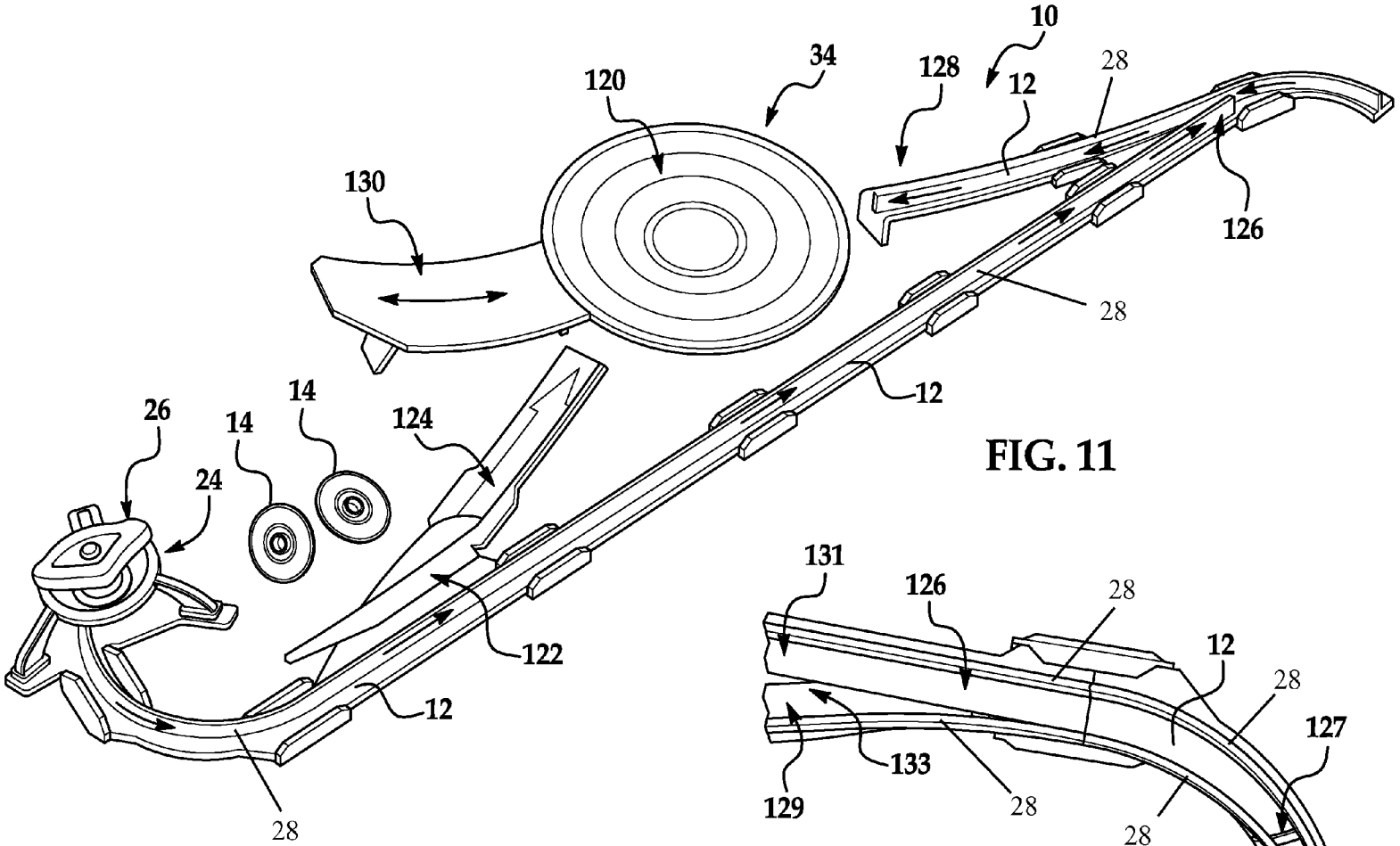
FIG. 11 is a perspective view of another alternative non-limiting exemplary embodiment of the toy play set.
Figure 12:
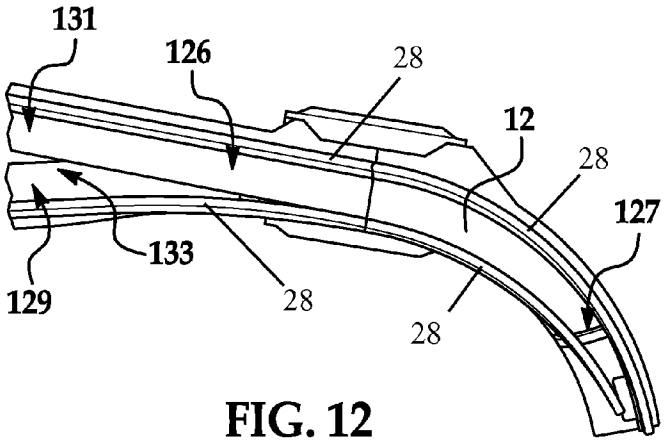
FIG. 12 is a perspective view of a whiplash region or a portion of configured for use with any of the toy play sets.
Figure 13B:
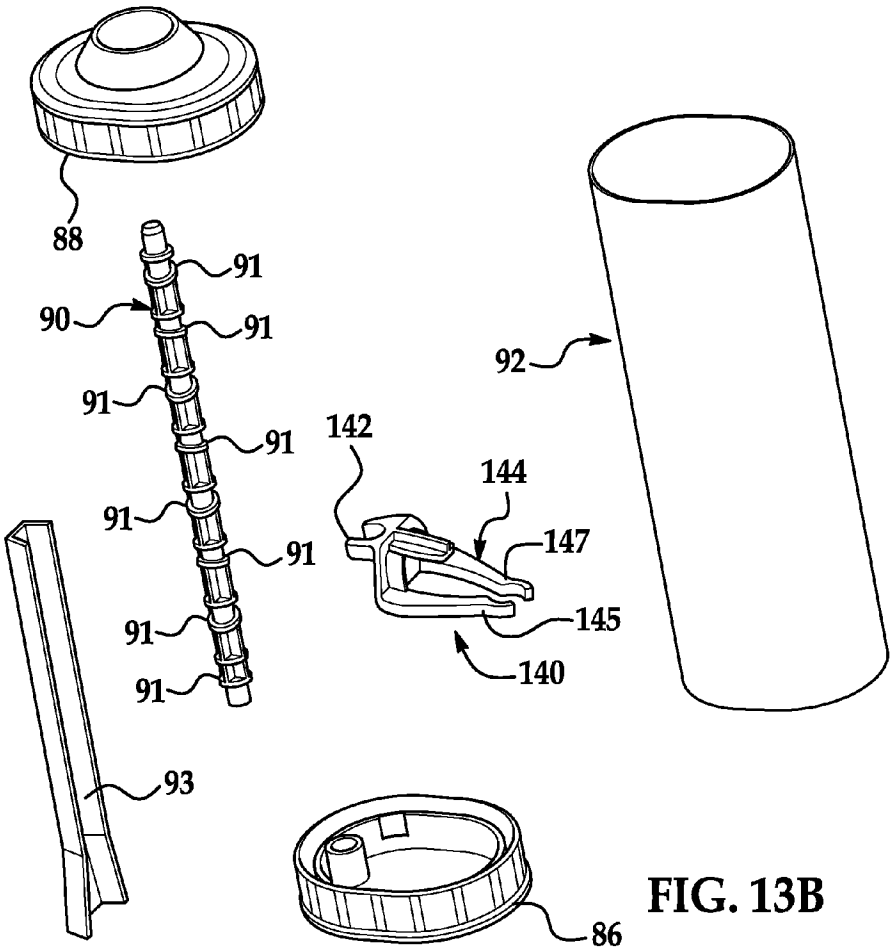
FIG. 13B is an exploded perspective view of the carrying case illustrated in FIG. 13A.
Figure 13A:
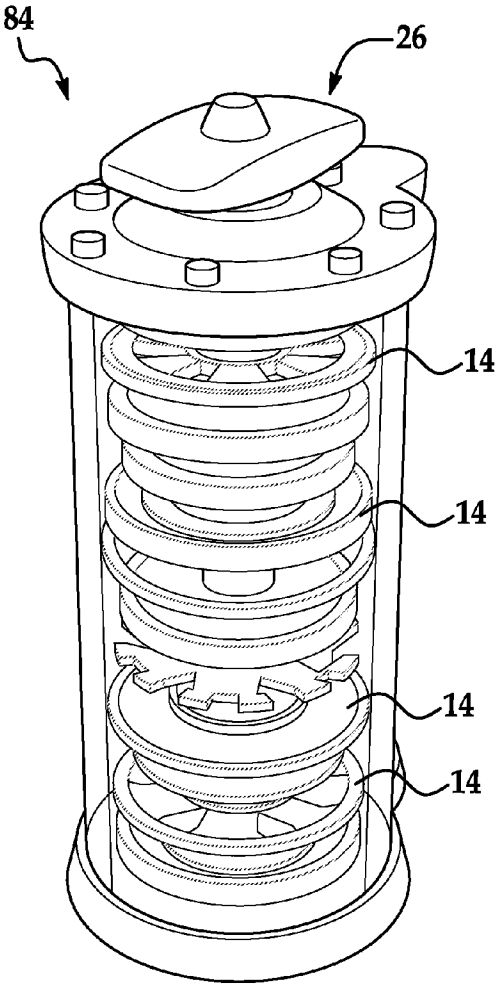
FIG. 13A is a perspective view of a carrying case for components of the toy play set.

Referring now to FIGS. 11 and 12, another or second embodiment of the rotating top assembly toy play set 10 is illustrated. As with the previous embodiments discussed above, the second embodiment is similar in many respects to the first embodiment described above and similar reference numerals are employed. In the second embodiment, the top receiving structure 34 comprises a rotatable surface 120 for receiving the rotatable top 14. In one embodiment, the rotating surface 120 is concave in shape and having its lowest point in the center so that multiple tops 14 rotating on surface 120 are directed towards each other in order to cause them to collide with each other. In alternative embodiment, surface 120 is stationary. However and in this embodiment, it is still provided with a concave surface. It is, of course, understood that alternative surface configurations are also considered to be within the scope of exemplary embodiments of the present invention. The guiding path 16 includes a divider 122 configured to divert the rotatable top 14 in one of two directions. The divider 122 may be formed of a foam material. First, the rotatable top 14 may be directed toward a first launch section 124 that directly launches the rotatable top 14 toward the top receiving structure 34. Second, the rotatable top 14 may continue on toward a whiplash region 126 that rapidly redirects the rotatable top 14 toward a second launch section 128 which then launches the rotatable top 14 toward the top receiving structure 34.

The whiplash region 126 comprises a redirector 127 that may be formed of a resilient material that provides flexibility upon contact with the rotatable top 14, such as a rubber band arrangement, for example. The whiplash region 126 comprises a first path 129 and a second path 131 both including the at least one magnetic material or metal 27 extending along a portion thereof, such as the ferromagnetic material described above. The ferromagnetic material does not fully extend to an end portion 133 of the first path 129, while the ferromagnetic material is disposed at the end portion 133 of the second path 131.

As illustrated, the sidewalls 28 defining the first path 129 and the second path 131 are arranged in a facing spaced relationship until they are configured to move towards each other proximate to the redirector or rubber band 127 such that as the top travels along the sidewall 28 of the first path 129, it will ultimately be moved closer to the sidewall 28 of the second path 131, which is proximate to the redirector or rubber band 127. In addition and as mentioned above, the ferromagnetic material or metal in the sidewall 28 of the first path 129 does not extend all the way to the area proximate to rubber band or redirector 127 however, the ferromagnetic material or metal in the sidewall 28 of the second path 131 extends closer to the redirector or rubber band 127 such that as the top 14 changes directions (e.g., first direction to the second direction, which in one non-limiting exemplary embodiment are generally opposite to each other for at least a portion thereof and at least illustrated by the arrows in FIG. 11) the magnet of the top 14 will be drawn to the metal or ferromagnetic material in the sidewall 28 of the second path 131 and then as it travels along the second path the sidewalls 28 of the first path 129 and the second path 131 will again become in a facing spaced relationship such that the top 14 will only be magnetically coupled to the metal or ferromagnetic material of the second path 131 (e.g., the spacing of the sidewalls 28 is sufficient to maintain the top 14 magnetically coupled to only one of the sidewalls 28, which in this case is that of the second path 131). As illustrated in at least FIG. 11, such an arrangement reliably attracts the rotatable top 14 toward the second launch section 128 subsequent to redirection by the redirector 127.

In the event of an overshoot of the top receiving structure 34 resulting from a launch from the second launch section 128, a ramp 130 is disposed adjacent the top receiving structure 34 and received tops 14 that may over shoot the surface 120 of the top receiving structure 34. The ramp 130 is inclined upwardly away from the top receiving structure and thus redirects the over shooting tops 14 by way of gravity back onto the top receiving structure 34. The illustrated embodiment of the top receiving structure 34 is relatively concave and provides a surface that enables a plurality of rotatable tops 14 to engage each other during movement on the top receiving structure 34. In another alternative embodiment, surface 120 is simply a concave surface that does not rotate.

Figure 14:
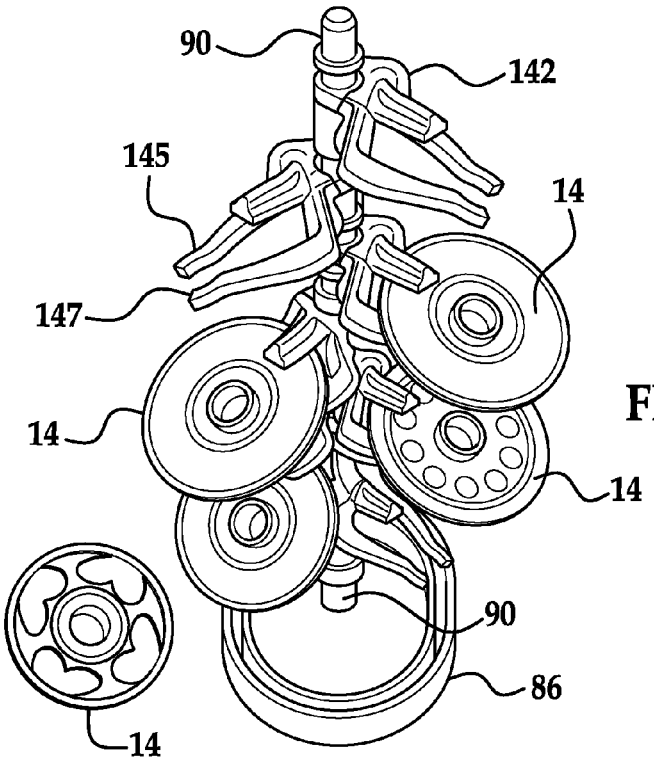
FIGS. 14 and 15 are perspective views of a plurality of tops secured to a portion of the carrying case and a first or deployed configuration.
Figure 15:
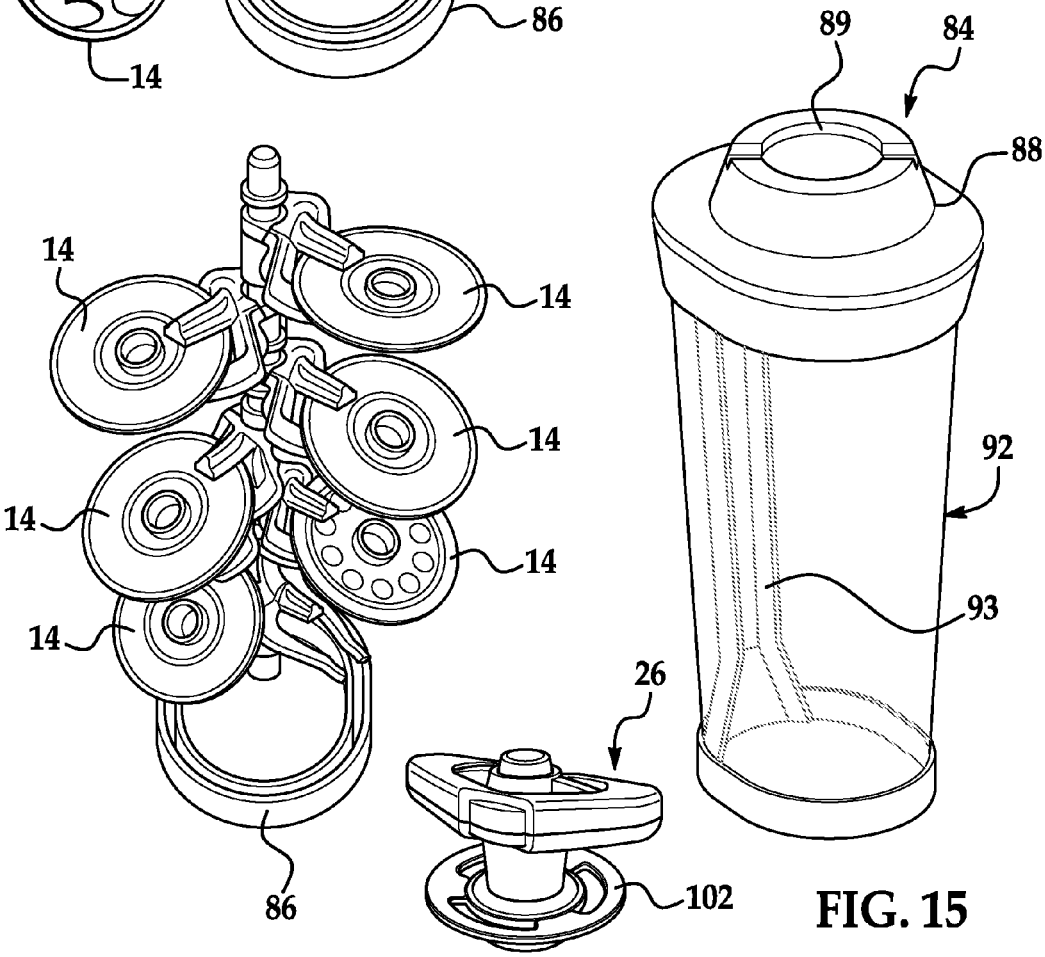
Figure 16:
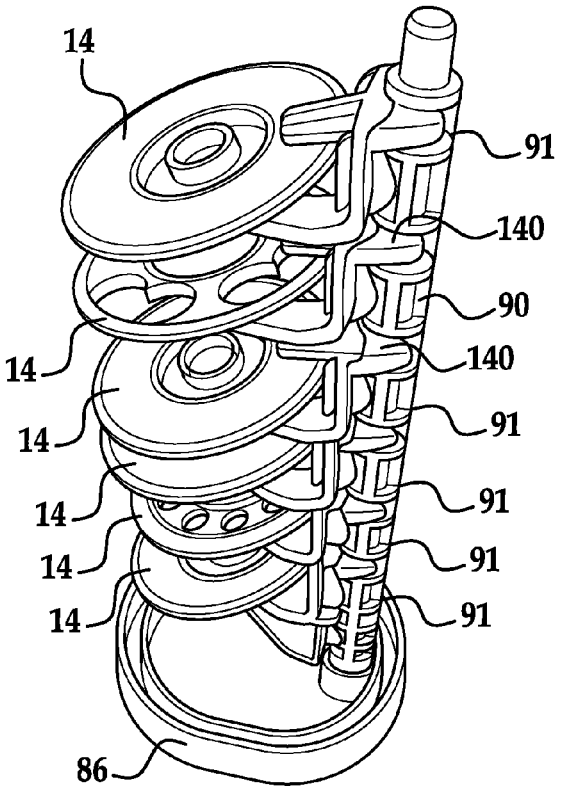
FIG. 16 is a perspective view of a plurality of tops secured to a portion the carrying case and a second or stowed configuration.
Figure 17:
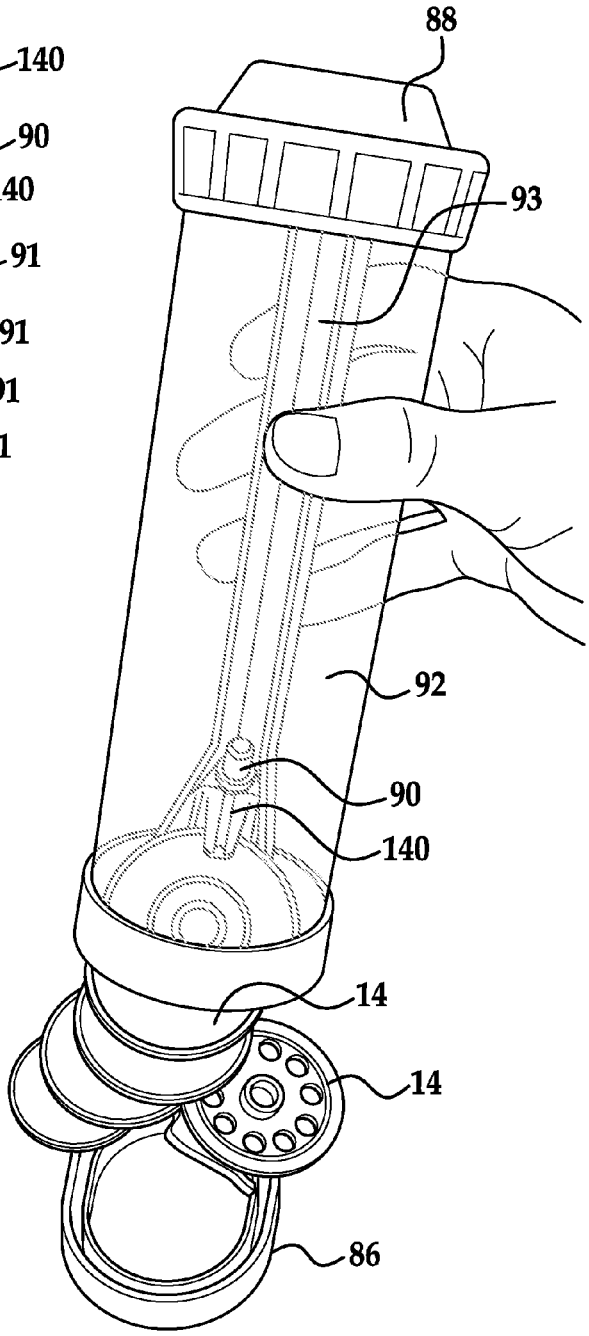
FIG. 17 is a perspective view illustrating a portion of the carrying case being secured to another portion of the carrying case and transitioning the plurality of tops secured thereto from the first or deployed configuration to the second or stowed configuration.
Figure 18:
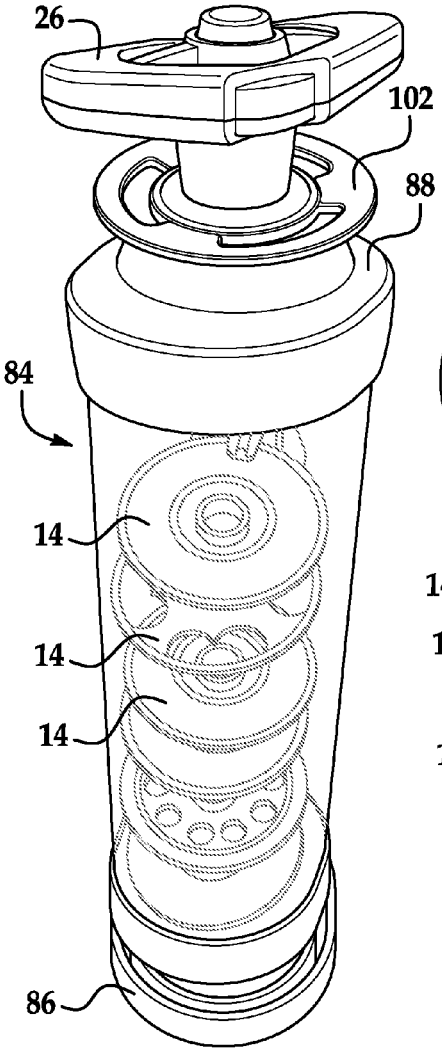
FIG. 18 is a perspective view illustrating the carrying case. In the second or stowed configuration.
Figure 19:
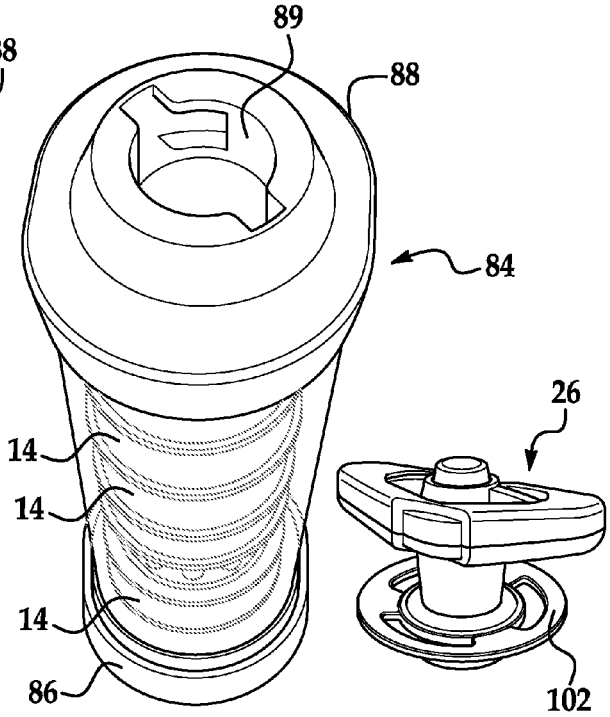
FIG. 19 is another perspective view of the carrying case.

Referring to FIGS. 13-19, a carrying case or storage case 84 configured to retain a plurality of the rotatable tops 14 is provided. The carrying case 84 includes a base portion 86, a lid 88 and a shaft 90 extending therebetween. The shaft 90 includes a plurality of angled portions or features 91 arranged to receive and rotationally or movably support a plurality of pinchers, grasping members or retaining members 140 that are rotatably mounted thereon. The angled portions are configured to allow the plurality of pinchers 140 to rotate outwardly upon removal of a cylindrical outer member 92. Specifically, each of the plurality of pinchers 140 includes an engagement region 142 that fittingly or snap fittingly engages a portion of the shaft 90 proximate to the angled portions or features 91. The plurality of pinchers 140 also include a top 14 supporting region 144 comprising a first member 145 and a second member 147. The first member 145 and the second member 147 are resilient members that are configured to grasp and releasably retain the rotatable top 14 such that the tops 14 can be stored on a respective one of the plurality of pinchers 140 that are rotationally or movably mounted to a shaft 90. Upon retraction of the shaft 90 from the cylindrical outer member 92, the plurality of pinchers 140 rotate to position the rotatable tops 14 in a staggered arrangement, such as an alternating right-left arrangement, for example (FIG. 14, FIG. 15). Upon insertion of the shaft 90 into the carrying case 84, and more specifically within the cylindrical outer member 92, the plurality of pinchers 140 rotate to position the rotatable tops 14 in relatively axial alignment therein. Such a rotation into the relatively axial alignment is facilitated by a chute 93 disposed within the cylindrical outer member 92. The chute 93 includes an open end and functions to push each of the rotatable tops 14 together upon insertion of the shaft 90 into the cylindrical outer member 92. In other words, as the outer cylindrical member 92 is slid over shaft 90 with the plurality of tops 14 rotationally secured thereto via the plurality of pinchers, grasping members or retaining members 140, the plurality of tops 14 and their associated retaining members 140 are rotated into an aligned configuration such that all of the tops can be received within outer cylindrical member 92 (see for example FIGS. 13A and 18). Once the outer cylindrical member 92 is removed, the plurality of tops in their associated retaining members 140 are able to rotate away from each other in a staggered alternating manner due to the configuration of features or angled portions 91 and gravity acting upon the tops 14 and retaining members 140. This staggered arrangement allows a user to easily grasp one of the tops 14 remove it from its associated retaining member 140 and play with it by for example, launching it along one of the track segments 12 via actuation of initiator 26. Thereafter, the plurality of tops 14 can be positioned to the second configuration within the cylindrical member 92 when they are no longer being used. In addition and in one non-limiting exemplary embodiment, cylindrical member 92 is transparent, so that all of the plurality of tops 14 stored within the carrying case or storage case or storage case 84 are viewable in the stowed configuration.

In addition to the rotatable tops 14, it is contemplated that a variety of other components may be secured to the carrying case 84. Such a component may include portions of the launch section, such as the initiator/launcher 26, for example, as shown in FIGS. 13A, 15, 18 and 19. In one non-limiting example, the initiator 26 with its attached retaining ring 102 can be secured to the carrying case 84 by having a portion received within an opening 89 of top 88 of the carrying case 84. This provides a convenient way for a user to store most of the components of the toy play set 10.

Figure 20:
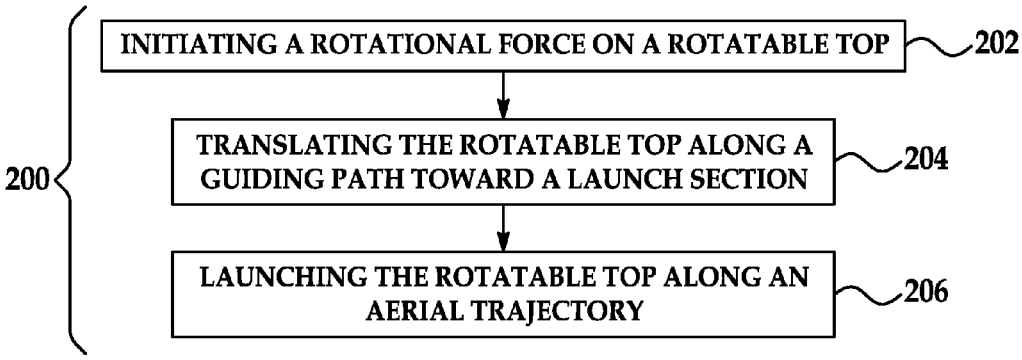
FIG. 20 is a flow diagram illustrating a method of launching a rotatable top.

As illustrated in the flow diagram of FIG. 20, and with reference to FIGS. 1-19, a method of launching 200 the rotatable top is also provided. The rotatable top 14 and the rotating top assembly toy play set 10 have been previously described and specific structural components need not be described in further detail. The method of launching 200 includes initiating a rotational force 202 on the rotatable top 14 to impart rotational motion. Based at least in part on the rotational motion of the rotatable top 14, translation of the rotatable top 204 along the guiding path 16 is achieved. As described above in conjunction with the illustrated embodiments, translation of the rotatable top 14 may be primarily achieve by the magnetic interaction between the rotatable top 14 and the at least one track segment 12. The method of launching 200 also includes launching the rotatable top along an aerial trajectory 206 that extends from the previously described launch section 32 to the top receiving structure 34 of any of the embodiments described above and illustrated in FIGS. 1-19.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A rotating top assembly toy play set comprising:

at least one track segment having a starter section, a launch section and a guiding path therebetween;

a rotatable top configured to translate along the guiding path; and a top receiving structure positionally spaced from the launch section for receiving the rotatable top subsequent to a flight of the rotatable top, wherein the flight extends along an aerial trajectory between the launch section and the top receiving structure.

2. The rotating top assembly toy play set of claim 1, wherein the rotatable top includes a magnet, wherein at least a portion of the at least one track segment includes a ferromagnetic material configured to guide the rotatable top along the at least one track segment through magnetic coupling between the magnet and the ferromagnetic material, wherein the ferromagnetic material is flush with a surface of a vertical sidewall of the track segment.

3. The rotating top assembly toy play set of claim 1, wherein the top receiving structure includes a plurality of apertures configured to receive the rotatable top after the flight of the rotatable top and wherein the toy play set further comprises a motorized booster for boosting the rotation of the top as it travels along the guiding path.

4. The rotating top assembly toy play set of claim 1, wherein the at least one track section includes a first path and a second path, and wherein the starter section is vertically arranged with respect to a vertical sidewall of the at least one track segment such that the rotatable top is in close proximity to the sidewall when it is releasably retained within an initiator secured to the starter section.

5. The rotating top assembly toy play set of claim 1, wherein the guiding path further comprises a first path and a second path each having a material located in a vertical wall to which a magnet of the top is magnetically attracted, wherein a resilient member is disposed between end portions of the first path from the second path and the material of the first path does not fully extend to the end portion thereof while the material of the second path extends to the end portion thereof such that the magnet of the top will be magnetically attracted to the material of the second path when it passes the end portion of the first path and is redirected to the end portion of the second path and wherein contact of the top with the resilient material disposed between the end portions of the first path and the second path will cause the top to change directions as it transitions from the end of first path to the second path.

6. The rotating top assembly toy play set of claim 1, further comprising: a launcher for imparting a rotational force to the top and a retaining ring removably secured to the launcher, wherein the retaining ring is configured to be received within a flange of an opening of the starter section such that when the rotatable top is secured to the launcher and the retaining ring is supported on the flange, a magnet of the rotatable top is in close proximity to a ferromagnetic material located within a vertical wall of the at least one track segment, the vertical wall being located below the opening of the starter section.

7. The rotating top assembly toy play set of claim 1, wherein the top receiving structure comprises a concave portion having a surface configured to receive the top after it is launched from the launch section, and wherein a ramp is located adjacent to the concave portion, wherein the ramp extends upwardly and away from the concave portion and is configured to receive a top that rotates off of the concave portion.

8. The rotating top assembly toy play set of claim 1, further comprising: a storage case configured to retain a plurality of the rotatable tops therein, wherein the storage case further comprises a base portion, a lid and a shaft extending therebetween, wherein the shaft includes a plurality of angled portions arranged to movably support a plurality of retaining members each configured to releasably retain the rotatable top therein.

9. The rotating top assembly toy play set of claim 8, wherein upon retraction of the shaft from a cylindrical outer member of the storage case, the plurality of retaining members position the rotatable tops in a staggered alternating arrangement and wherein upon insertion of the shaft into the outer member of the storage case, the plurality of retaining members rotate to position the rotatable tops into axial alignment with each other.

10. The rotating top assembly toy play set of claim 9, wherein the storage case further comprises a chute located within the cylindrical outer member, the chute being configured to cooperate with the shaft in order to align the plurality tops when they are inserted into the outer cylindrical member.

11. A rotating top assembly toy play set comprising:

at least one track segment;

a starter section configured to rotationally launch a top therefrom;

wherein the top has a magnet such that once launched from the starter section, the top is magnetically coupled to a ferromagnetic material of the at least one track segment, wherein the starter section is vertically arranged with respect to the ferromagnetic material and the ferromagnetic material is flush with a vertical sidewall of the at least one track segment;

a launch section configured to launch the top into air after it is traveled along the at least one track segment; and a top receiving structure disposed in spaced proximity to the launch section, wherein the top receiving structure is configured to receive the rotatable top.

12. The rotating top assembly toy play set of claim 11, wherein the top receiving structure includes a plurality of apertures configured to receive the rotatable top after the flight of the rotatable top.

13. The rotating top assembly toy play set of claim 11, further comprising: a launcher for imparting a rotational force to the top and a retaining ring removably secured to the launcher, wherein the retaining ring is configured to be received within a flange of an opening of the starter section such that when the rotatable top is secured to the launcher and the retaining ring is supported on the flange, the magnet of the rotatable top is in close proximity to the ferromagnetic material located within the vertical wall of the at least one track segment, the vertical wall being located below the opening of the starter section.

14. The rotating top assembly toy play set of claim 13, wherein the retaining ring further comprises a cylindrical collar located above the top when the top is secured to the launcher and the cylindrical collar is configured to stabilize the launching of the top from the launcher.

15. The rotating top assembly toy play set of claim 13, wherein the top receiving structure comprises a concave portion having a surface configured to receive the top after it is launched from the launch section, and wherein a ramp is located adjacent to the concave portion, wherein the ramp extends upwardly and away from the concave portion and is configured to receive a top that rotates off of the concave portion and wherein the ferromagnetic material is flush with a surface of the vertical wall and additional ferromagnetic material is located on an opposite surface of the vertical wall.

16. The rotating top assembly toy play set of claim 14, wherein the guiding path further comprises a first path and a second path each having a material located in a vertical wall to which the magnet of the top is magnetically attracted, wherein a resilient member is disposed between the end portions of the first path and the second path and the material of the first path does not fully extend to the end portion thereof while the material of the second path extends to the end portion thereof such that the magnet of the top will be magnetically attracted to the material of the second path when it passes the end portion of the first path and is redirected to the second path and wherein contact of the top with the resilient material disposed between the end portions of the first path and the second path will cause the top to change directions as it transitions from the end of the first path to the second path.

17. A method of launching a rotatable top comprising:

initiating a rotational force on the rotatable top for imparting a rotating motion on the rotatable top;

translating the rotatable top along a guiding path of at least one track segment toward a launch section of the at least one track segment; and launching the rotatable top along an aerial trajectory extending from the launch section to a top receiving structure.

18. The method of claim 17, wherein translating the rotatable top comprises magnetically guiding the rotatable top along the guiding path, wherein the rotatable top includes a magnet and wherein at least a portion of the at least one track segment includes a ferromagnetic material located in a vertical wall of the at least one track segment.

19. The method of claim 18, wherein the top receiving structure includes a plurality of apertures configured to receive the rotatable top therein and the ferromagnetic material is disposed on opposite sides of portions of the vertical wall, proximate to a starter section of toy play set and wherein the starter section is positioned above the at least one track segment.

20. The method of claim 17, further comprising the step of: boosting the rotation of the top with a motorized booster located along the guiding path and wherein the top receiving structure comprises a target having a concave portion for retaining the rotatable top after the flight of the rotatable top.

* * * * *